United States Patent [19]

Kaessen

[11] 4,278,858

[45] Jul. 14, 1981

[54] LIQUID LEVEL RESPONSIVE PROXIMITY SWITCH

[75] Inventor: Donald A. Kaessen, Ashland, Ohio

[73] Assignee: The Marley-Wylain Company, Mission, Kans.

[21] Appl. No.: 724,247

[22] Filed: Sep. 17, 1976

Related U.S. Application Data

[63] Continuation-in-part of Ser. No. 558,940, Mar. 17, 1975, abandoned.

[51] Int. Cl.[3] ..... H01H 35/18

[52] U.S. Cl. ..... 200/84 B; 200/84 C

[58] Field of Search ..... 200/84 B, 84 C, 190, 200/214, 209, 230; 335/49, 205–207, 51–53; 73/308, 313; 340/244 R, 244 A; 318/482; 417/40, 41

[56] References Cited

U.S. PATENT DOCUMENTS

| | | | |
|---|---|---|---|
| 1,010,620 | 1/1905 | Crumpton | 335/52 |
| 2,147,506 | 2/1939 | Stoner | 335/52 |
| 2,495,149 | 1/1950 | Taylor | 200/84 C |
| 2,564,655 | 8/1951 | Binford | 200/84 C |
| 2,752,461 | 6/1956 | Euler | 200/85 R |
| 3,673,524 | 6/1972 | Lowry | 200/209 |
| 3,904,999 | 9/1975 | Rich et al. | 335/52 |

FOREIGN PATENT DOCUMENTS

| | | | |
|---|---|---|---|
| 443289 | 4/1927 | Fed. Rep. of Germany | 335/52 |
| 669932 | 4/1952 | United Kingdom | 200/84 C |

*Primary Examiner*—David Smith, Jr.
*Attorney, Agent, or Firm*—Robert F. Ziems

[57] ABSTRACT

A liquid level responsive proximity switch for submersible sump and sewage pumps in which a magnetic float, normally buoyed on mercury or other conductive liquid, is submerged by a movable magnetic actuator to displace the mercury into contact with a pair of switch electrodes. The mercury, magnetic float and electrode assembly are housed in permanently sealed casing having a downwardly opened chamber for the actuator under the magnetic float.

29 Claims, 10 Drawing Figures

LIQUID LEVEL RESPONSIVE PROXIMITY SWITCH

CROSS-REFERENCE TO RELATED APPLICATIONS

This application is a Continuation-in-Part of Copending Application Ser. No. 558,940, filed Mar. 17, 1975 now abandoned and entitled Liquid Level Responsive Proximity Switch.

BACKGROUND OF THE INVENTION

This invention relates to electric proximity switches and more particularly, it concerns liquid level responsive switches of a type especially suited for use with submersible sump and sewage pumps.

A major problem with which the submersible sump and sewage pump industry has and continues to face is the need for a reliable liquid level responsive switch capable of withstanding repeated maintenance-free operation for long periods of time in the environment in which such pumps are used. For example, the humid atmosphere to which a switch of this type is continuously exposed necessitates either the use of highly exotic and expensive materials in operative switch components to avoid malfunction as a result of corrosion or a complete isolation of such components from the atmosphere. While the switch itself is not intended to operate while submerged, the possibility of submergence as a result of flood conditions, for example, must be accounted for in the switch design in order to avoid the electrical shock hazards incident to submersion.

Because of the predictable gravitational orientation of liquid level responsive switches, float operated mercury switches have been looked upon as a likely candidate for a solution principally because of the facility provided for hermetically encapsulating the switch terminals or electrodes. In particular, switches in which a tiltable mercury capsule is moved between open and closed positions by a float or buoyant weight carried permanent magnet have shown promise primarily because of the capability for isolating all of the electric and mechanical switch components in a sealed enclosure, leaving only the actuating magnet exposed to the humid atmosphere or to be wetted on submersion of the switch. Although magnetically actuated mercury switches of this type have approached solutions of the basic problems associated with submersible sump and sewage pump switches, there is need for improvement in a number of respects. For example, tilting movement of the hermitically sealed mercury capsule and switch electrodes requires a measure of flexibility in the leads extending to the capsule such that the current carrying capacity of the leads and thus of the switch is limited. Although the need for lead flexibility may be circumvented by force multiplying mechanical linkages capable of transmitting movement of the float carried magnet to capsule tilting movement, such linkages add both to manufacturing costs and to the potential for malfunction. In addition, tiltable mercury switches are extremely sensitive to gravitational orientation and therefore require a degree of care in installation difficult to achieve in many submersible pump environments. Also in such switches, there is potential for fouling the actuating magnet either mechanically such as by trash preventing its movement with the float to which it is attached or magnetically such as by permeable trash material tending to reduce the effective force of the magnet.

SUMMARY OF THE PRESENT INVENTION

In accordance with the present invention, the problems heretofore encountered with liquid level proximity switches for controlling the operation of submersible sump and sewage pumps are substantially alleviated by enclosing in a permanently sealed casing a stationary sealed reservoir partially filled with mercury or other conductive liquid in which one of two switch electrodes is submerged, the reservoir containing a magnetic float normally buoyed by the mercury but submersible therein by attraction to a vertically movable external magnetic actuator to displace the mercury into contact also with the other of the two electrodes. The magnetic actuator is located in a downwardly opening casing chamber positioned under the reservoir and is supported by means sensitive to the level of liquid to be pumped, such means including either a float supported rod or a compression spring calibrated to yield under the gravitational load of submersible weights in air but to sustain the reduced gravitational load of the weights when submerged in liquid to be pumped.

Several structural embodiments of the invention are contemplated for adaptation to various types of submersible pump installations. For example, the switch casing may be of a configuration to facilitate a direct mounting to the housing of a submersible pump without interference with operation of the required external floats. Alternatively, the casing may be of an elongated cylindrical configuration to be suspended either on or independently of the pump under conditions in which lateral space is limited. Also different forms of liquid level sensing devices may be employed such as a float supported rod or weights suspended on a flexible line in a manner such that the force exerted by the line is reduced as the weights are submerged in the water to be pumped. In each instance, the basic organization of functioning components in accordance with the present invention is retained.

Among the objects of the present invention are: the provision of an improved liquid level proximity switch; the provision of such a switch particularly suited for use with submersible sump and sewage pumps and in which all electrical components are completely and permanently isolated from the switch casing exterior; the provision of a switch of the type referred to capable of actuation by movement of magnetic means in a manner such that operation of the switch between open and closed conditions occurs quickly or with a snap action; the provision of a switch of the aforementioned type in which switch actuation is effected by positive displacement of mercury or other conductive liquid without requiring movable or flexible conductive switch leads and which is relatively insensitive to gravitational orientation; the provision of a magnetically actuated mercury switch of this type which is operable when tilted with respect to a vertical axis; the provision of such a switch in which the number of moving parts is retained to an absolute minimum; the provision of a magnet actuated proximity switch in which submersion of the actuating magnet is avoided thereby preventing mechanical and magnetic fouling by foreign materials; and the provision of such an improved magnetically actuated proximity switch which may be ruggedly constructed of relatively low-cost materials and adapted to diverse types of installations.

Other objects and further scope of applicability of the present invention will become apparent from the detailed description to follow taken in conjunction with the accompanying drawings in which like reference numerals designate like parts.

DETAILED DESCRIPTION OF THE PREFERRED EMBODIMENTS

Figure 1:
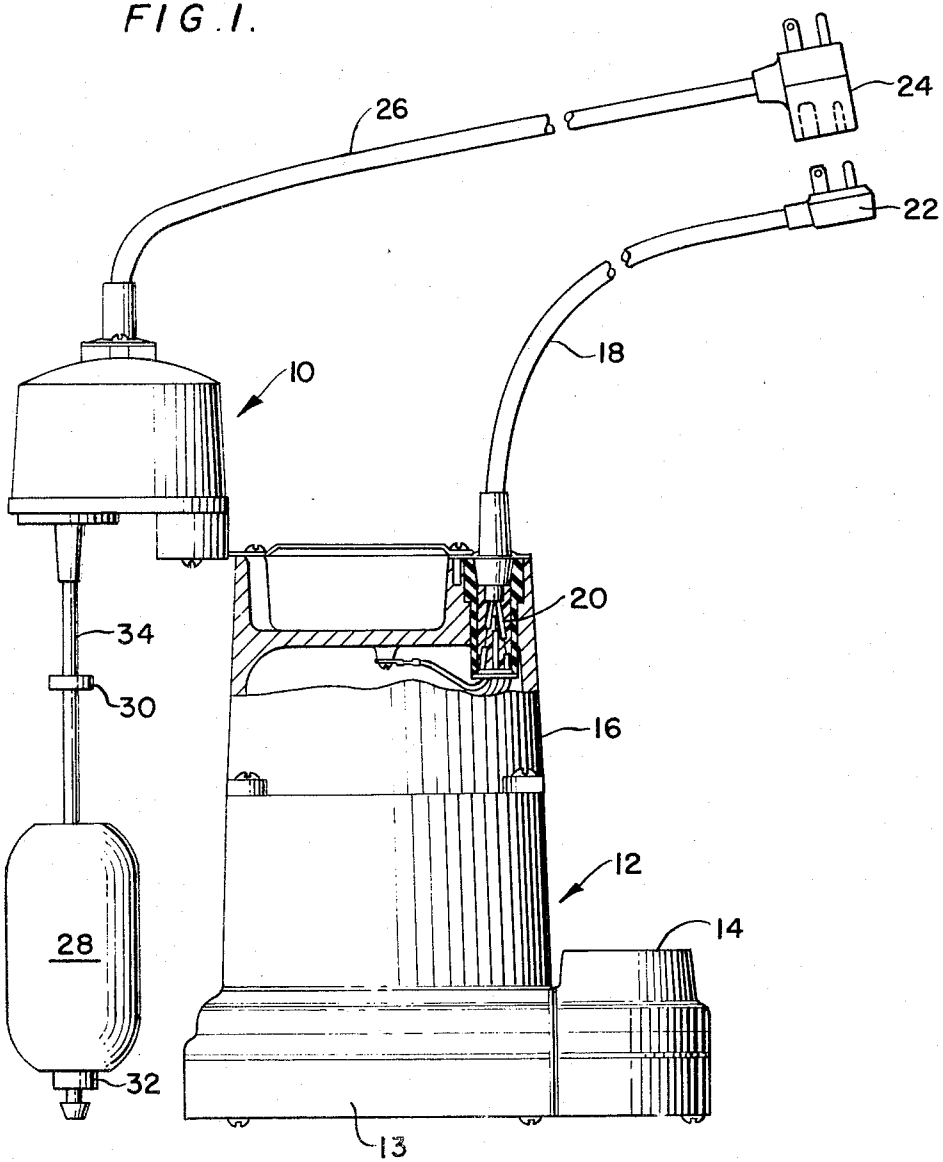
FIG. 1 is a side elevation illustrating the liquid level proximity switch of the present invention attached to a submersible pump.

In FIG. 1 of the drawings, one embodiment of the switch of the present invention is designated generally by the reference numeral 10 and shown attached to a submersible pump 12. The pump 12 is a conventional electric motor driven centrifugal pump having a downwardly opening central inlet (not shown) in an impeller housing 13 having an outlet 14 to which an appropriate discharge conduit may be attached. An electric motor for driving the pump is contained in the sealed housing 16 supported on the impeller housing 13 and through which electric current is supplied by a motor cord 18 by way of a potted lead junction box 20. The motor cord 18 is fitted at its free end with a conventional plug 22 connected to the receptacle portion of a plug through type connector 24 at the end of a switch cord 26. The connector 24, in turn, is plugged into a conventional outlet (not shown) and operates to complete a circuit to the pump motor through the switch 10. The organization of the cords 18 and 26 as well as their interconnection by the plug 24 is merely illustrative of one acceptable approach to electrically interconnecting the switch 10 and the motor of the pump 12, it being understood that the switch and pump may be electrically interconnected in alternative manners well known in the submersible pump art.

Also in accordance with well known submersible sump pump operation, the switch 10 controls operation of the pump 12 in accordance with the level of liquid in which the pump is submerged. To this end, the switch is actuated to complete a circuit through the pump motor by a member buoyed by the liquid to be pumped, in this instance a float 28 supported for limited sliding movement between upper and lower adjustable stops 30 and 32 on a vertically movable rod 34. Thus it will be appreciated that as the float moves upwardly against the upper stop 30, continued upward movement of the float will carry with it the rod 34 to actuate the switch 10 from an open position to a closed position in a manner which will be described fully below. Actuation of the switch in this manner will result in operation of the pump 12 until the level of liquid pumped is reduced, lowering the rod 34 and reactuating the switch to an open position terminating operation of the pump 12. Automated operation of submersible sump pumps in this manner, in itself, is well known and needs little further elaboration. Also in this respect, normal operation of the pump 12 as well as the switch 10 in the organization illustrated in FIG. 1 will not result in the switch 10 being submerged in the liquid being pumped. Under abnormal conditions, however, where the capacity of the pump 12 is exceeded by flooding, for example, it is possible that the level of liquid in which the pump is submerged will rise above the level at which the switch is located, causing it also to be submerged.

In FIGS. 2–5 of the drawings, the structure of a preferred embodiment of the switch 10 is shown to include an outer casing established by a dome-like body 36 having a peripheral bottom flange 38 to which a base 40 is permanently fixed and sealed to establish an inner sealed chamber 42. Both the body 36 and base 40 are preferably molded from synthetic resinous materials to facilitate a fusion of the base to the flange 38 such as by ultrasonic welding though other moisture impervious, non-magnetic materials may be employed to isolate the chamber 42 from the casing exterior.

Figure 2:
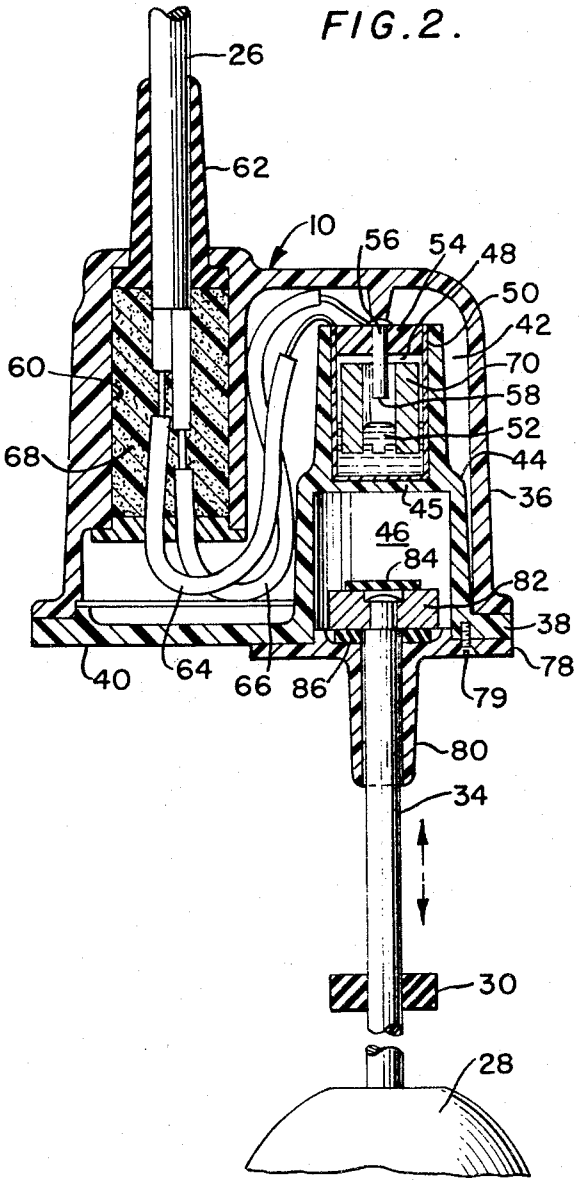
FIG. 2 is a vertical cross-section on an enlarged scale illustrating internal components of the switch shown in FIG. 1.
Figure 3:
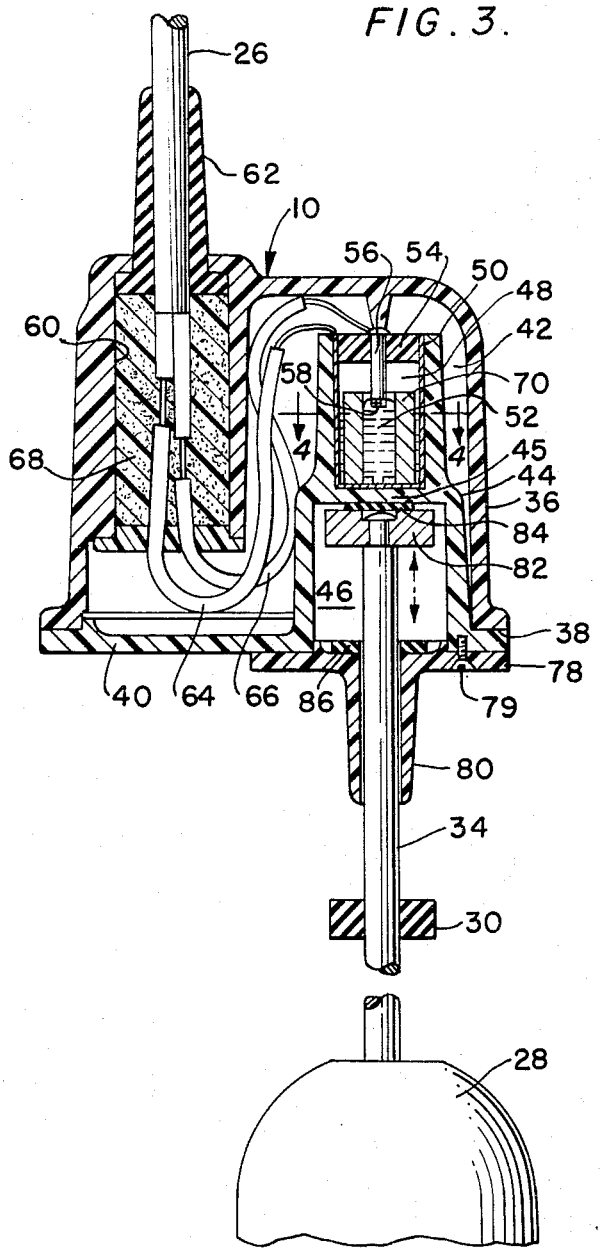
FIG. 3 is a cross-section similar to FIG. 2 but illustrating the operating components of the switch in a different operating condition.

As shown in FIGS. 2 and 3, the base 40 is provided with an integral upstanding portion 44 having a centrally disposed transverse wall portion 45 to establish a downwardly opening external chamber 46 underlying a cup-like reservoir 48 extending with the chamber 42. The reservoir 48 is provided with a shell 50 of conductive, non-magnetic material such as stainless steel and is partially filled with a conductive liquid such as mercury 52. The top of the reservoir 48 is closed by a plug 54 of non-conductive ceramic, glass or plastic material which supports a post-like electrode 56 depending downwardly into the reservoir 48 to the extent that a contact portion at the lower end 58 of the electrode is spaced above the normal level of mercury in the reservoir as shown in FIG. 2. The hermetically sealed switch capsule thus formed by the reservoir and plug would be evacuated of air and filled with an inert or arc quenching gas, like hydrogen, and the electrode materials and/or electrode plating materials would be suitable for the current conduction requirements. These factors are well known in the state of the art on liquid conductive switches.

Displaced laterally from the upstanding portion 44 of the base 40 and formed in the casing body 36 is a lead junction chamber 60 into which the switch cord 26 extends by way of a strain relief sleeve 62 for connection to a pair of switch leads 64 and 66. The junction chamber 60 is filled with potting material 68 to ensure sealing integrity for isolating the inner chamber 42 from the exterior of the casing and also electrical insulation of lead connections to the cord 26. The switch lead 64 is connected to the conductive shell 50 of the reservoir or capsule 48, which functions as a normally contacting electrode, whereas the lead 66 is connected to the post electrode 56. It will be appreciated that because of the spaced relationship of the lower end 58 of the post electrode 56 with respect to the upper level of mercury 52 or other conductive liquid in the capsule 48, the leads 64 and 66 will normally be electrically unconnected to establish a switch open condition.

Figure 4:
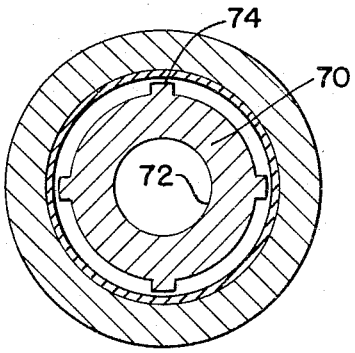
FIG. 4 is a cross-section taken on line 4—4 of FIG. 3.
Figure 5:
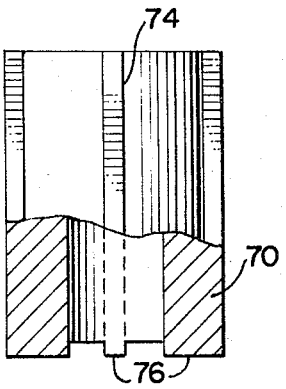
FIG. 5 is a side elevation in partial cross-section of a magnetic float employed in the switch of the invention.

An annular magnetic float 70 is disposed within the capsule 48 and normally buoyed by the mercury 52. The preferred configuration of the float 70 is illustrated in FIGS. 4 and 5 of the drawings as a generally elongated toroid to establish an internal cylindrical opening 72 of a diameter sufficiently in excess of the diameter of the post electrode 56 to allow free vertical movement of the float 70 relative to the post electrode 56 and to be electrically isolated therefrom. In this latter respect, the float 70 may be formed of an insulating material such as rubber or ceramic magnetic materials to alleviate any concern for circuit closure through the magnetic float. A series of vertical ribs 74 are symmetrically disposed about the external periphery to guide the magnetic float through limited vertical movement without lateral displacement in the capsule 48. The bottom of the magnetic float 70 is also provided with downwardly depending foot portions 76 which are angularly coextensive with the ribs 74. As a result of this configuration, the mercury 52 will be permitted to flow freely about the bottom of the magnetic float 70.

As shown in FIGS. 2 and 3 of the drawings, the downwardly open mouth of the external chamber 46 is partially closed by a disc-like closure-member 78 detachably secured by suitable means such as screws 79 and having a depending float rod guide 80 through which the float rod 34 extends. Positioned within the chamber 46 and fixed to the upper end of the float rod 34 is a circular magnetic actuator 82. Elastomeric cushions or shock stops 84 and 86 are fitted about the upper and lower surfaces of the magnetic actuator to provide a cushioned abutment stop for upward movement of the magnetic actuator 82 against the top of the chamber 46 and for downward movement thereof against the disc 78, respectively.

The term "magnetic" is used herein to characterize both the float 70 and the actuator 82 is intended to encompass both permanent magnets as well as magnetically permeable material which will be drawn toward a permanent magnet under its magnetic field of force. In this context, therefore, it is contemplated that either both the float 70 and the actuator 82 may be permanent magnets with polarity reversed so that they will be drawn toward each other by mutual attraction of their respective magnetic fields or alternatively, either may be permanent magnets while the other may be of magnetically permeable material and hence drawn by magnetic force toward each other. Also it is contemplated that various of well known magnetically permeable substances may be used in both the actuator 82 and the float 70 though materials which are non-corrosive in the wet or humid environment of the switch are preferred particularly in the case of the actuator 82 which is not hermetically sealed from the atmosphere on the exterior of the switch casing.

Operation of the switch 10 in accordance with vertical movement of the float 28 to control operation of the submersible pump 12 in the manner aforementioned may be appreciated by reference to FIGS. 2 and 3 of the drawings. In particular, the combined weight of the rod 34 and the float 28, when unbuoyed by water or other material in which the pump is submerged, will cause the magnetic actuator 82 to be supported against the lower cushion stop 86 and the closure disc 78 in the position illustrated in FIG. 2. When in this position, the actuator 82 is sufficiently spaced from the magnetic float 70 so that buoyancy of the magnetic float on the mercury 52 will be essentially unaffected by magnetic force. As the float 28 moves upwardly against the upper stop 30, the magnetic actuator 82 will be carried upwardly along with the rod 34 at a relatively slow rate until the magnetic attraction force between the float 70 and the actuator 82 becomes strong enough to cause the float 70 to submerge in the mercury. Thereafter, the magnetic attraction forces increase so that the actuator will be drawn suddenly against the top of the chamber 46 with simultaneous movement of the float 70 against the bottom of the capsule reservoir 48. Submergence of the magnetic float 70 in this manner will displace the mercury upwardly through the cylindrical opening 72 to a level submerging the lower end 58 of the electrode 56. Accordingly, circuit continuity will be effected between the conductive liner or electrode 50 and the electrode 56 by the mercury to establish a switch closed condition. As the pump 12 is operated to reduce the level of liquid on which the float 28 is supported, the combined weight of the rod 34 and the float 28 will ultimately establish a gravitation force stronger than the magnetic force holding the actuator 82 and the magnetic float 70 so that the actuator will return to the position illustrated in FIG. 2 and allow the magnetic float 70 to again float on the mercury 52 and reopen the switch.

In light of the proximity switch organization thus described, several desirable attributes will now be more clearly apparent. For example, the organization of the housing enables the sealed switch electrode assembly to be easily pre-assembled as a unit with the casing base 40 and then during manufacture completely isolated from the casing exterior after assembly of the base 40 with the body 36. The magnetic float 70, being the only movable component in the sealed enclosure, moves independently of any mechanical connection with other parts. Because of its configuration as illustrated in FIGS. 4 and 5, which allows the mercury 52 to flow freely about the bottom thereof, a relatively high tolerance of switch inclination is permitted without affecting its operation. Although the actuator 82 is exposed to the atmosphere on the casing exterior, it is not only an easily replaced component by removal of the closure disc 78 but is also protected from the deleterious effects of magnetically permeable foreign material by virtue of its enclosure in the chamber 46. In particular, the bell jar configuration of the chamber 46 coupled with the extension provided by the float rod guide 80 will prevent liquid from entering the chamber in the event the switch 10 is submerged by flooding for example.

Figure 8:
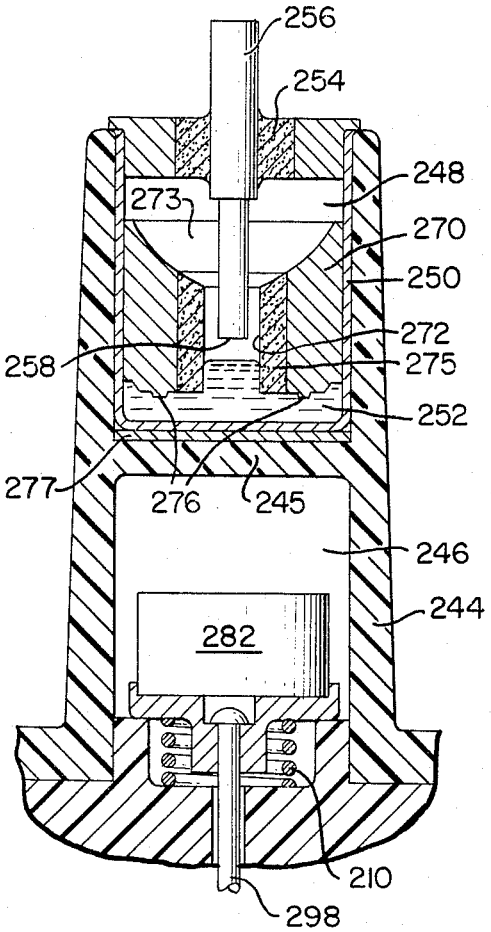
FIG. 8 is a vertical cross-section of an alternative embodiment of the liquid level proximity switch of the present invention.
Figure 9:
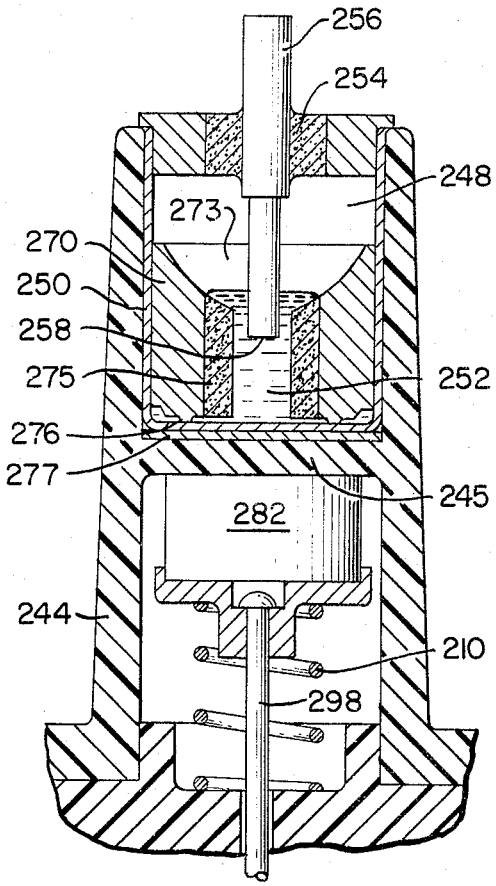
FIG. 9 is a vertical cross-section of the switch embodiment illustrated in FIG. 8 but in a different operating condition.
Figure 10:
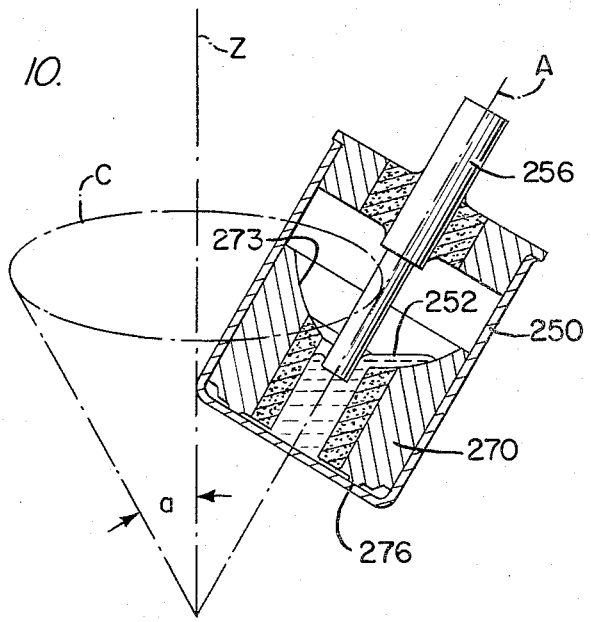
FIG. 10 is a vertical cross-section through the electrode contacts of the alternative embodiment of FIGS. 8 and 9 depicting operation with the axis of the switch inclined or tilted.

In FIGS. 8–10 of the drawings, an alternative embodiment of the proximity switch is illustrated and in which parts corresponding in function to parts previously described are designated by reference numbers having the same tens and unit numerals in a two-hundred series. Thus, in FIGS. 8 and 9 wherein the modified switch structure is shown respectively in opened and closed conditions, the integral upstanding portion 244 of the base again includes a centrally disposed transverse wall portion 245 to establish the downwardly opening external chamber 246 underlying the reservoir or switch capsule 248. The switch capsule is also defined by a hermetically sealed liner 250 of non-magnetic conductive material, such as stainless steel, closed at its upper end in part by a ceramic or otherwise insulative section 254 supporting a post-like electrode 256 having a lower end 258 normally positioned above the level of mercury 252 contained in the capsule.

One of the principle differences between the embodiment of FIGS. 8–10 and the previously described embodiment resides in the construction of the magnetic float 270. Although the float 270 is again generally torus shaped to define a central or internal cylindrical opening 272, the upper end face of the magnetic float is provided with a dish-shaped surface 273 to establish an essentially semi-spherical concavity extending from the cylindrical opening 272 to near the outer periphery of the magnetic float 270. Also it will be notd that the exterior peripheral surface of the float 270 in the embodiment of FIGS. 8–10 is a smooth cylindrical surface of a diameter slightly less than the inside diameter of the cylindrical conductive sleeve 250. While the respective external diameter of the float and internal diameter of the sleeve 250 provide an adequate annular clearance for free vertical or axial movement of the float with respect to the sleeve 250, the annular space tends to prevent passage of a high surface-tension liquid such as mercury. As a result, submerging the float 250 in the mercury 252 causes a displacement thereof primarily up through the central opening 272 to maximize the level differential at the electrode 256. Also the opening 272 is circumscribed by an annulus of ceramic or other suitable dielectric material 275 having little or no surface affinity for mercury. The depending legs 276 are retained to allow for free passage of the mercury about the lower end of the float 270 and also to minimize any vacuum effect which could occur upon separating two submerged flat surfaces in contact.

The snap-action operation of the switch embodiment illustrated in FIGS. 8–10 of the drawings is augmented, particularly where the actuator 282 is a permanent magnet and the float 270 is an unmagnetized permeable or low-reluctance material, by the provision of a thin, low-reluctance iron or steel disc 277 underlying the metallic shell 250 of the capsule 248 on the opposite side of the transverse wall 245 from the actuator 282. The magnetically permeable disc 277 increases the magnetic holding power of the magnet actuator 282 and maintains it in the upper or switch-closing position until the weight on the actuator, as a result of low external water level, breaks the actuator 282 cleanly away with a quick snap-action to open the switch.

A principal advantage of the embodiment illustrated in FIGS. 8 and 10 is the facility it provides for achieving effective switch operation under conditions in which the vertical axis A of the switch capsule 248 is tilted or at an angle a to vertical reference line Z. Because of the relatively large vertical displacement of mercury within the central opening 272 and with respect to the central electrode 256, the axis A of the capsule may be inclined with respect to the vertical axis Z such that the angle e a may be as large as about 20° to 25°. This facility for tilting the axis of the capsule is in good measure, the result of the close annular tolerance space between the magnetic float 270 and cylindrical shell 250 such that little or none of the conductive liquid or mercury 252 will pass upwardly along the sides of the submerged float 270. The cylindrical configuration of the float 270 and of the shell 250 permits inclination or tilting throughout a 360° circle C which defines with the axis a a cone of tilting about the vertical axis Z. Further, the dish-shaped concavity 273 in the upper end of the magnetic float 270 functions as a temporary storage chamber for the displaced mercury and assures return of all of the displaced mercury back through the central opening 272.

Figure 6:
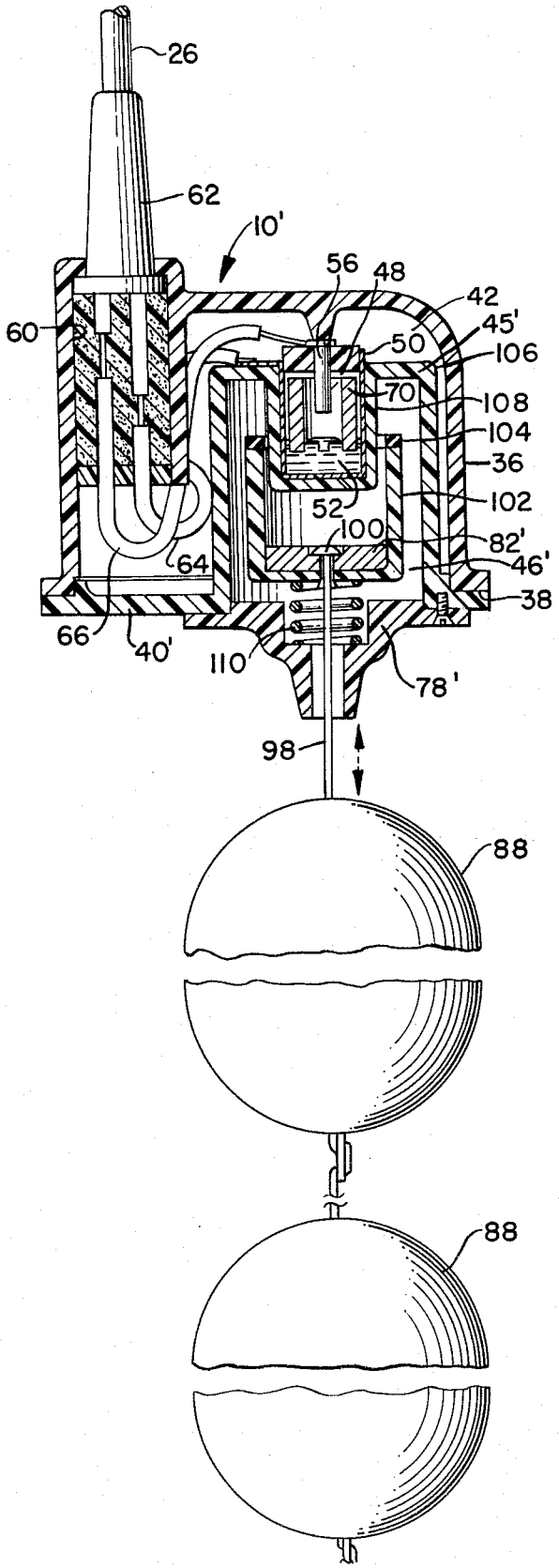
FIG. 6 is a vertical cross-section illustrating a modified embodiment of the switch.

In FIG. 6 of the drawings, a modified embodiment of the proximity switch is designated generally by the reference numeral 10'. Parts identical to the previously described embodiment are designated by the same reference numerals whereas parts corresponding to components in the previous embodiment but modified for adaptation to the embodiment of FIG. 6 are designated by primed like reference numerals. In this instance, the switch is adapted for actuation by displacement weights 88 suspended in spaced relation on a flexible line 98 secured to the magnetic actuator 82' by a suitable means such as a headed ferrule 100. The magnetic actuator 82' is supported by a movable cup-shaped member 102 having a combined sealing and cushioning gasket 104 about its upper peripheral lip. The base 40° is provided with an enlarged dome-like recession 106 forming the external chamber 46' and the transverse wall portion 45' to isolate the inner and outer chambers 42 and 46'. The transverse wall portion 45' is formed with a depending central portion 108 to establish the recess for the switch capsule 48. Also it will be noted that the cup 102 is provided with a depth such that when the magnetic actuator 82' moves upwardly against the bottom of the capsule 48, the gasket 104 will engage the transverse wall portion 45' at the top of the dome-shaped recession 106 in the base 40'.

The cup-shaped member 102 is supported on a calibrated compression spring 110 which, when extended, will advance the actuator 82' and the cup 102 upwardly to a position in which the magnetic float 70 will be drawn downwardly in the mercury 52 to effect a switch closed condition in a manner similar to that described above with respect to the embodiment of FIGS. 1 to 5. The normally open condition of the switch in this instance is effected by the gravitation force of the weights 88 acting to compress the spring 110 and lower the position of the actuating magnet 82'. However, when the weights 88 are submerged in liquid to be pumped, the gravitational force exerted by them is reduced by the weight of the liquid displaced so that the spring 110 will advance the magnetic actuator 82' upwardly. The weights and spring are proportioned so that the spring will compress when the liquid level is at about the center of lower weight, and will extend when the water level is at about the center of the upper weight.

The embodiment of FIG. 6 possesses the desirable features incorporated in the embodiment of FIGS. 1–5 and in addition provides an enhanced measure of protection against the entrance of magnetically permeable foreign material between the magnetic actuator 82 and the mercury reservoir 48. For example, if the switch 10' was accidentally dropped into water or other material, any water which might enter the external chamber 46' would be prevented from access to the actuator itself by the cup 102 being closed against the top of the chamber. This condition would occur inasmuch as the weights 88 would not be operative under these circumstances to compress the spring 110.

The arrangement of the flexible line 98 and weights 88 of the embodimet illustrated in FIG. 6 is particularly suitable for use with the switch embodiment described above with respect to FIGS. 8–10. In other words, the flexible nature of the line 298 (in FIGS. 8–10) will allow the weights to operate in a true vertical orientation while at the same time effecting movement of the magnetic actuator 282 under the influence of the spring 210 to actuate the magnetic float 270 even though the latter is tilted in the manner depicted by FIG. 10 of the drawings. An arrangement incorporating this combination of actuating components is particularly desirable in many sump pump applications where the condition of the liquid in which the weights are submerged is swirling or turbulent and where the installation conditions prevent the attainment of truly vertical switch orientation. Such conditions often occur, for example, where the sump pump and switch organization must be lowered to an irregular bottom of a sump in which the pump is used.

Figure 7:
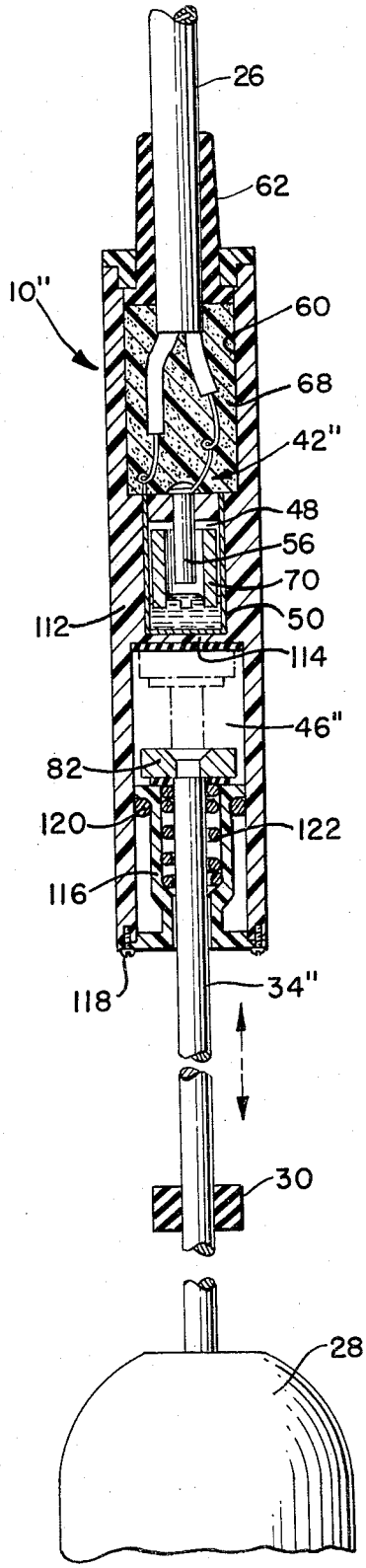
FIG. 7 is a vertical cross-section illustrating a still further embodiment of the present invention.

A further alternative embodiment of the proximity switch is designated generally by the reference numeral 10″ in FIG. 7 of the drawings. Here also, parts interchangeable with parts of the previous embodiments are designated by like reference numerals whereas those parts which are modified but correspond to parts of the previously described embodiments are designated by double primed similar reference numerals. In this embodiment, the switch casing is established by an elongated integral formation 112 having a transverse wall portion 114 separating the sealed inner chamber 42″ and thus the mercury capsule 48 and related suitable components from the lower external chamber 46″. Since the leads of the cord 26 in this embodiment are connected directly to the electrodes 50 and 56, the chamber 42″ is coextensive with the junction chamber 60 and switch capsule reservoir 48.

The magnetic actuator 82 is again positioned in the chamber 46 and movable between an upper switch closing position against the transverse wall portion 114 and a lower switch opening position in which it is supported by a generally spool-shaped closure member 116 detachably secured against the bottom of the formation 112 such as by screws 118. The spool-shaped configuration of the closure member 116 establishes a provision for guiding the float rod and in addition supports a magnetically permeable ring 120 near its upper end. In this instance, the actuator 82 is a permanent magnet which will be retained in its lowermost or switch open position by a magnetic attraction to the ring 120. As a result, the actuator 82 in the switch 10″ will be retained magnetically against upward movement of the float 28 until the buoyant forces acting on the float exceed the magnetic attraction forces holding the actuator 82 in its lower position. When the force of magnetic attraction between the actuator 82 and the ring 120 is exceeded, the actuator will move very quickly with a snap-action upwardly to the switch closing position against the transverse wall portion 114 to submerge the magnetic float 70. Similarly, downward movement of the actuator 82 in the switch 10″ to reopen the switch will occur suddenly in snap-action fashion.

To offset the mass of the float rod 34″, particularly in installations which require a long float rod, a compression spring 122 is positioned in the annular space between the rod and the closure member 116. As distinguished from the spring 110 in the embodiment of FIG. 6, the spring 122 in this embodiment is selected so that the actuator 82 will remain in its lower normal position until the float 28 and rod 34″ are positively moved upwardly by buoyant force. The spring 116, in balancing the weight of the rod 34″, will function to reduce its effective mass to achieve a more pronounced snap-action effect in movement of the actuator to its upper switch closing position.

Thus it will be appreciated that the present invention provides a highly improved proximity switch for use particularly with submersible sump and sewage pumps and by which the abovementioned objectives are completely fulfilled. While alternative embodiments of the invention have been described, it is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

I claim:

1. A proximity switch for starting and stopping electric pump motors comprising;

a casing having a transverse wall to partially establish and separate a sealed inner chamber and a downwardly opening outer cylindrical chamber;

an hermetically sealed, cylindrical reservoir in said inner chamber overlying said outer chamber and in coaxial alignment therewith, said reservoir being partially filled by conductive liquid and spaced from said outer chamber by an electrically insulating transverse dividing wall;

an annular magnetic float having an axial central opening and normally supported on said conductive liquid;

a first electrode on the cylindrical inner surface of said reservoir near the lower end thereof and thus normally contacting said conductive liquid;

a second depending post-like electrode in said reservoir and having a contact portion normally positioned above the level of said conductive liquid and having a transverse dimension to fit within the central opening of said annular magnetic float;

a magnetic actuating member supported for linear movement along the axis of said outer chamber between a lower switch-opening position spaced from said magnetic float and an upper switch-closing position in which said float is magnetically attracted to said actuator and in which said float and said actuator are magnetically retained against opposite sides of said transverse dividing wall to displace said conductive liquid upwardly in said reservoir to submerge the contact portion of said second electrode and thereby establish circuit continuity between said electrodes; and means to move said magnetic actuating member between said lower and upper positions in response to independent external liquid level variations and by magnetic attraction thereof with said magnetic float in the region of said upper position, whereby movement of such magnetic attraction will effect an essentially instantaneous displacement of said magnetic float.

2. The apparatus recited in claim 1 wherein said casing comprises molded non-magnetic impervious material having said transverse dividing wall as an integral portion thereof.

3. The apparatus recited in claim 1 wherein said actuating member moving means comprises a vertically movable linear member having an upper end to which said actuating member is fixed and extending downwardly out of said outer chamber, and float means supported on the portion of said linear member extending from said outer chamber.

4. The apparatus recited in claim 1 wherein said actuating member moving means comprises yieldable means supporting said actuator under a biasing force in a direction tending to move the actuator to said upper position.

5. The apparatus recited in claim 4 wherein said actuating member moving means further comprises a flexible line and a displacement weight supported by said line externally of said outer chamber, said yieldable means having a biasing force less than the gravitational force on said line and said displacement weight in air but more than the gravitational force thereof when submerged in water.

6. The apparatus recited in claim 4 wherein said actuating member moving means comprises a rod and wherein the biasing force of said yieldable means counterbalances the weight of said rod, thereby to enable snap-action movement of said actuator to said upper switch closing position.

7. A proximity switch comprising:

a casing of molded non-magnetic impervious material comprising a dome-like body portion and a base portion sealed to said body portion, said base portion having an upstanding formation with an integral transverse wall portion, said transverse wall portion defining with said body portion an hermetically sealed inner chamber and with said upstanding formation, a downwardly opening outer chamber;

a reservoir in said inner chamber in a position overlying said outer chamber and containing conductive liquid, said base portion having an integral upstanding wall portion to establish said outer chamber and said reservoir;

a first electrode normally contacting said conductive liquid;

a second electrode in said reservoir and having a contact portion normally positioned above the level of said conductive liquid;

a magnetic float normally supported on said conductive liquid; and a magnetic actuating member supported for movement in said outer chamber between a normal lower position spaced from said magnetic float and an upper switch closing position in which said float is magnetically attracted to said actuator to displace said conductive liquid upwardly in said reservoir to submerge the contact portion of said second electrode and thereby establish circuit continuity between said electrodes.

8. The apparatus recited in claim 7 wherein said transverse wall portion is centrally disposed in said upstanding formation thereby to establish the bottom of said reservoir and the top of said outer chamber.

9. The apparatus recited in claim 7 wherein said reservoir depends within said outer chamber from said transverse wall portion and including a cup-shaped member for supporting said magnetic actuator.

10. The apparatus recited in claim 9 wherein said cup-shaped member is formed with an upper peripheral lip having a sealing means for engaging said transverse wall portion at the top of said outer chamber.

11. A proximity switch comprising:

a casing having a transverse wall separating inner and outer chambers, said outer chamber having a generally central axis parallel with a normally vertical axis of said casing;

a mercury switch capsule in said inner chamber, said capsule comprising a cylindrical shell of electrically conductive material having an axis aligned with the central axis of said outer chamber and partially filled with mercury, a magnetic float normally supported on the mercury, said magnetic float having a central axial opening and a cylindrical outer peripheral surface defining with said shell an annular clearance dimensioned to allow relative axial movement of said float and said shell but to impede passage of mercury between said float and said shell, a depending electrode supported on the axis of said shell to be aligned with said central axial opening and electrically insulated from said shell, the lower end of said depending electrode being normally spaced above the level of mercury in said capsule; and a magnetic actuating member supported for movement along the axis of said outer chamber between a lower switch-opening position spaced from said magnetic float and an upper switch-closing position in which said float is magnetically attracted to said actuator and in which said float and said actuator are magnetically retained against opposite sides of said transverse dividing wall to displace said mercury upwardly within said central float opening to submerge the lower end of said depending electrode and establish circuit continuity between said depending electrode and said shell.

12. The apparatus recited in claim 11 wherein said float is formed having an upper end shaped to define a concavity concentric with said central axial opening.

13. The apparatus recited in claim 12 wherein said concavity is of semi-spherical configuration.

14. The apparatus recited in claim 11 wherein said float has a lower end formed with depending leg-like protrusions to allow free flow of mercury under said lower end.

15. The apparatus recited in claim 11 wherein said magnetic float is formed of unmagnetized low-reluctance material and said actuating member is a magnet, and including a member of low-reluctance material fixed to said transverse wall between said actuator and said capsule.

16. The apparatus recited in claim 15 wherein said member of low-reluctance material comprises a disc in said inner chamber under said capsule.

17. The apparatus recited in claim 11 including means to move said magnetic actuating member between said lower and upper positions in response to independent external liquid level variations and by magnetic attraction thereof against said transverse wall to affect an essentially instantaneous displacement of said magnetic float.

18. The apparatus recited in claim 17 wherein said actuating member moving means comprises yieldable means supporting said actuator under a biasing force in a direction tending to move the actuator to said upper position, a flexible line depending from said actuator and a displacement weight supported by said line externally of said outer chamber, said yieldable means having a biasing force less than the gravitational force on said line and said displacement weight in air but more than the gravitational force thereof when submerged in water.

19. The apparatus recited in claim 17 wherein said magnetic float is formed of unmagnetized low-reluctance material and said actuating member is a magnet and including a disc of low-reluctance material under said capsule and aligned with the central axis of said outer chamber.

20. A mercury switch comprising:

an hermetically sealed cylindrical shell of non-magnetic, conductive material containing mercury, an axial electrode supported by and electrically insulated from said shell, said axial electrode being concentric with said shell and extending downwardly to a contact end normally spaced above the level of mercury contained in said shell, an annular float normally buoyed by the mercury and having a central axial opening to receive said axial electrode, said float having an outer cylindrical surface defining with said shell an annular clearance dimensioned to allow relative axial movement of said float and said shell but to impede passage of mercury between said float and said shell, said float being formed of magnetic material; and actuating means spaced axially under said shell and operable to submerge said float by magnetic attraction to displace the mercury upwardly through said central axial opening into contact with the contact end of said axial electrode.

21. The apparatus recited in claim 20 wherein one of said float and said actuating means is a permanent magnet.

22. The apparatus recited in claim 21 wherein the other of said float and said actuating means is formed of unmagnetized low-reluctance material.

23. The apparatus recited in claim 20 wherein said float is formed of unmagnetized low-reluctance material and said actuator is an axially displaceable permanent magnet.

24. The apparatus recited in claim 21 including a transverse wall of non-magnetic, non-conductive material between said permanent magnet and said shell.

25. The apparatus recited in claim 24 including a member of magnetic material fixed in said wall and axially aligned with said shell and said actuator.

26. The apparatus recited in claim 20 wherein the dimensions of said float and said central opening, the quantity of mercury in said cylindrical shell and the position of said contact end of said axial electrode are related to develop a vertical displacement of mercury within said central axial opening sufficient to position the contact end of said axial electrode above the level of the mercury when said annular float is buoyed by the mercury and to displace the mercury upwardly through said central opening to a level above the contact end of said axial electrode when said shell is tilted to approximately 25° from vertical.

27. The apparatus recited in claim 20 wherein the annular float is provided with an upper end shaped to define a concavity concentric with said central axial opening.

28. The apparatus recited in claim 27 wherein said concavity is of semi-spherical configuration.

29. The apparatus recited in claim 28 wherein said float has a lower end formed with depending leg-like protrusions to allow free flow of mercury under said lower end.

* * * * *

UNITED STATES PATENT AND TRADEMARK OFFICE

CERTIFICATE OF CORRECTION

PATENT NO. : 4,278,858

DATED : July 14, 1981

INVENTOR(S) : DONALD A. KAESSEN

It is certified that error appears in the above—identified patent and that said Letters Patent is hereby corrected as shown below:

Column 1, line 52, "hermitically" should read --hermetically--.

Column 4, line 38, "with" should read --within--.

Column 7, line 14, "notd" should read --noted--;

lines 53, 58 and 67, "a" should read --a--.

Column 8, line 19, "40°" should read --40'--;

line 29, "dome-shaped" should read --dome-shape--.

Signed and Sealed this

Sixth Day of October 1981

[SEAL]

*Attest:*

GERALD J. MOSSINGHOFF

*Attesting Officer*

*Commissioner of Patents and Trademarks*